US006478447B2

(12) United States Patent
Yen

(10) Patent No.: US 6,478,447 B2
(45) **Date of Patent: *Nov. 12, 2002**

(54) DEVICE ARRANGEMENT OF LED LIGHTING UNITS

(76) Inventor: George Yen, 2F, 15 Alley 11, Lane 327, Sec.2, Chung Sun Rd. Chung Ho, Taipei (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/447,834

(22) Filed: Nov. 23, 1999

(65) Prior Publication Data

US 2002/0024821 A1 Feb. 28, 2002

(51) Int. Cl.[7] ..... F21V 14/02

(52) U.S. Cl. ..... 362/231; 362/232; 362/250; 362/800; 257/89; 257/99

(58) Field of Search ..... 362/800, 231, 362/239, 250; 257/99, 88, 89, 100; 313/512

(56) References Cited

U.S. PATENT DOCUMENTS 5,276,380 A * 1/1994 Tang ..... 313/500
5,641,611 A * 6/1997 Shieh et al. ..... 257/40

FOREIGN PATENT DOCUMENTS

JP 403171780 A * 7/1991
JP 406076049 A * 3/1994

OTHER PUBLICATIONS

News VCSEL—Technical Information Support—Published by TrueLight Corporation.*

* cited by examiner

*Primary Examiner*—Sandra O'Shea
*Assistant Examiner*—Hargobind S. Sawhney
(74) *Attorney, Agent, or Firm*—Troxell Law Office PLLC

(57) ABSTRACT

The present invention discloses a light-emitting diode (LED) light source and, more particularly, the lighting units that homogeneously mix the light beams from LEDs of different shapes to achieve a superior light mixing effect.

6 Claims, 3 Drawing Sheets

DEVICE ARRANGEMENT OF LED LIGHTING UNITS

BACKGROUND OF THE INVENTION

1. Field of Invention

The present invention relates to the improvement of a light-emitting diode (LED) light source and, more particularly, to the development of lighting units that homogeneously mix the light beams from LEDs of different shapes to achieve a superior light mixing effect.

2. Related Art

Light-emitting diode (LED) technology has had a great progress. The lighting efficiency and unit luminosity are grown logarithmically. Therefore, using LEDs as lighting units in practice should be within a number of years. However, since each kind of LEDs is made by a different material, the lighting method is also different. This in turn affects the beam shape from the LED. This feature causes no problem in most applications, yet has a great influence on certain situations.

Our company discovers this light source phenomenon when doing research on a special luminaire composed of highly luminous RGB LEDs. So the present invention is accomplished after many times of experiments.

Since the lighting method of LEDs belongs to semiconductor lighting, the light emitted has a unique wavelength. Although there are white LEDs, they are made by having blue light as the primary light and applying a fluorescent to convert the blue light into lights of different wavelengths. Thus the lighting efficiency is not high enough. Under the current circumstances that the LED lighting efficiency cannot be promoted, the RGB LEDs as the light sources have the most efficient luminosity. For example, the luminosity of a single white diode is about 2.0 CD (at the angle of 15 degrees), that of a blue diode is about 3 CD, but that of a green diode can reach 8 CD and that of a red diode can have 3.5 CD or so. Taking each of the red, green, and blue LEDs to form a lighting unit would have a total luminosity of about 15 CD. However, taking three white LEDs to form a light unit would have a total luminosity between 6 to 8 CD. Considering the price, the three red, green, and blue LEDs would cost about ⅔ of the price of three white LEDs. Therefore, the luminaire composed of the RGB LEDs for now and the near future definitely would be more practical than using white LEDs. It can also achieve the effect of varying color by controlling the output of each single color LED.

Since the beam shape 11 (as shown in FIG. 2) of the red LED 1 (as shown in FIG. 1) is different from those beam shapes 21, 31 (shown in FIG. 4) of the blue LED 2 and the green LED 3 (shown in FIG. 3), respectively, therefore, when all three colors are projected on an object it will not be perfectly white and has inhomogeneous speckles 101 on the rim of the beam. The reason is that the red LED 1 only need one whisker, thus the central area is dark and the light beam after a resin lens has a circular shape (as shown in FIG. 2). The blue and green LEDs 2, 3 need two whiskers for electric conduction, these two whiskers usually set on the diagonals. Thus the dark areas of the chip rest on the diagonals. After the projection through lenses, the beams become elliptical (as shown in FIG. 4). This shape is not easy to be modified by a correction resin lens because mass production could not assume the precision required. Accordingly, when those two LEDs 2, 3 and the red LED 1 combine to form a luminaire, beams of different colors would have different projection shapes (shown in FIG. 5) and red speckles 101 form at places where blue and green light cannot reach.

There are various methods for solving the above situation. One is to place lenses with different refractivities in front of the LEDs so that the lenses can have different refractive effects on lights from individual LEDs. This method, however, is not practical. Not only does the lens cost too much, the lens also has to be redesigned once the arrangement of the LEDs changes. Another method is to place a dispersion plate in front of the LEDs to fully mix all colors and the light emerging therefrom would be very homogeneous. Yet the application of the luminaire would be limited because the dispersed light can not be focused and has a lower luminosity.

SUMMARY OF THE INVENTION

It is an object of the present invention to provide a light-emitting diode (LED) light source and, more particularly, a structure of lighting units that homogeneously mix the light beams from LEDs of different shapes to achieve a superior light mixing effect.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 2:
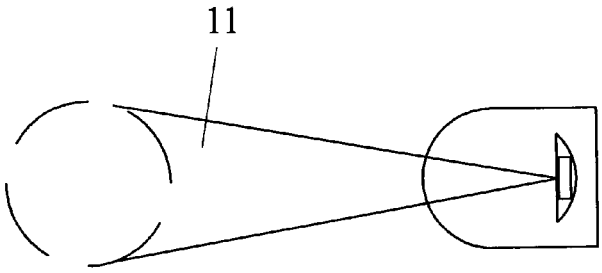
FIG. 2 is a schematic view of the projection beam from the red LED of FIG. 1.
Figure 1:
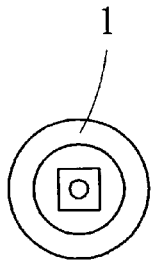
FIG. 1 is a front view of a usual red LED.
Figure 4A:
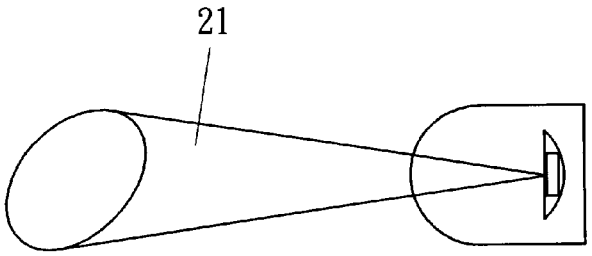
FIG. 4 shows schematic views of the projection beams from the blue and green LEDs of FIG. 3.
Figure 3A:
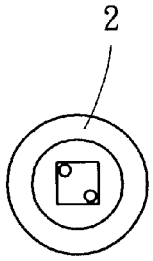
FIG. 3 shows front views of usual blue and green LEDs.
Figure 4B:
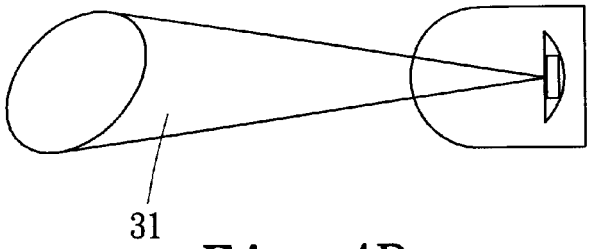
Figure 3B:
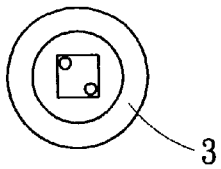
Figure 5A:
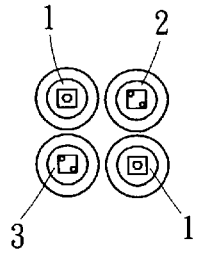
Prior Art Fig. 5A
FIG. 5 is a schematic view of the projection beam from a conventional luminaire composed of blue, green and red LEDs.
Figure 6A:
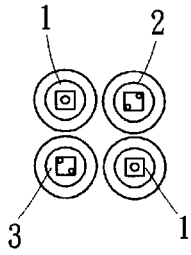
FIG. 6 is a schematic view of the projection beam from a luminaire that has two groups of red, green, and blue LEDs rotated from each other by 90 degrees according to the present invention.
Figure 7A:
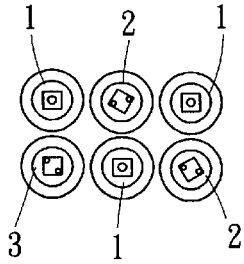
FIG. 7 is a schematic view of the projection beam from a luminaire that has three groups of red, green, and blue LEDs rotated from one another by 60 degrees according to the present invention.
Figure 5B:
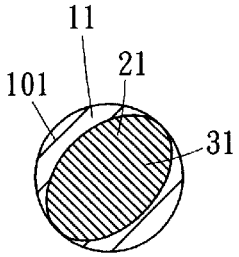
Prior Art Fig. 5B
Figure 6B:
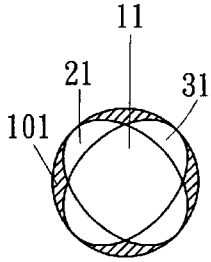
Figure 7B:
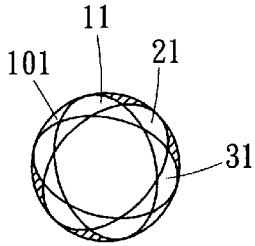
Figure 8:
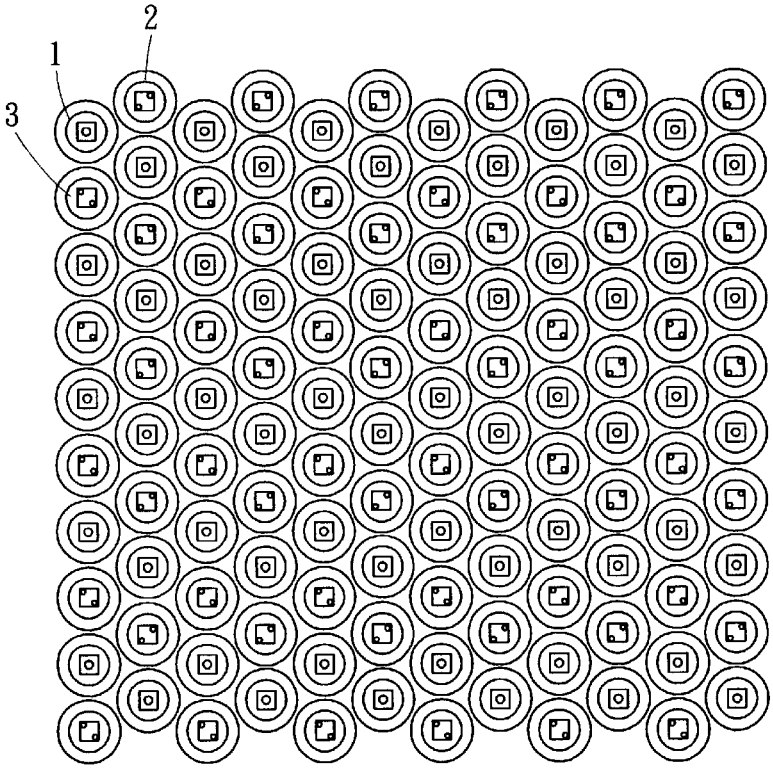
FIG. 8 is a schematic view of the arrangement of two groups of red, green, and blue LEDs rotated 90 degrees apart in a luminaire of the present invention.

After years of research, the instant invention is obtained. The principle is to dispose all light-emitting elements (a practical LED luminaire has at least tens of units) into a plurality of groups. Each group rotates an angle (as shown in FIGS. 6 and 7) so that part of the blue and green elliptical beams 21, 31 are rotated to obtain homogeneously mixed light. Of course the speckles could not be eliminated even if each lighting units is assigned a different angle, yet since each LED has a slightly different lighting character the speckles are not easy to be identified after mixture. In practical testing, rotating only half of the lighting units by 90 degrees (as shown in FIGS. 6 and 8) can achieve a fairly good effect. If all lighting units are separated into three groups with each of them differs from one another by a rotation of 60 degrees, a much better effect can be obtained (as shown in FIGS. 7 and 9).

Figure 9:
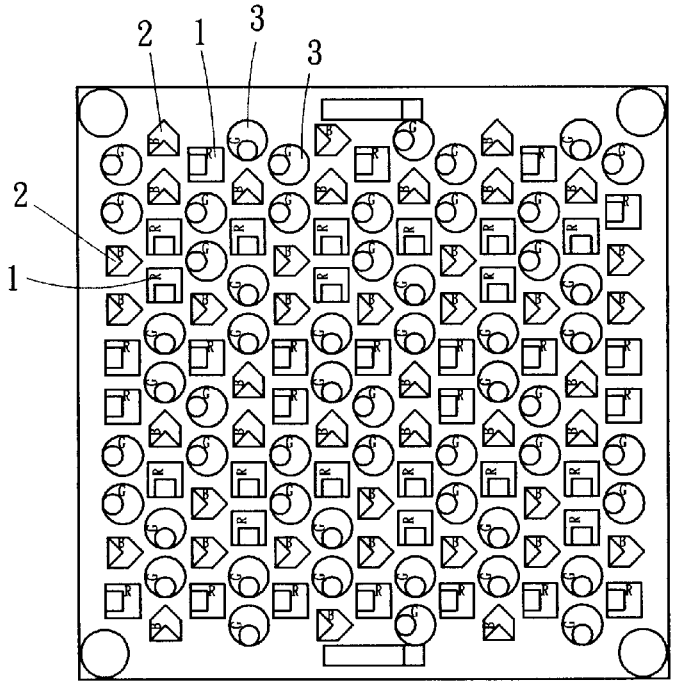
FIG. 9 is a schematic view of the arrangement of three groups of red, green, and blue LEDs rotated 60 degrees apart in a luminaire of the present invention.
Figure 10:
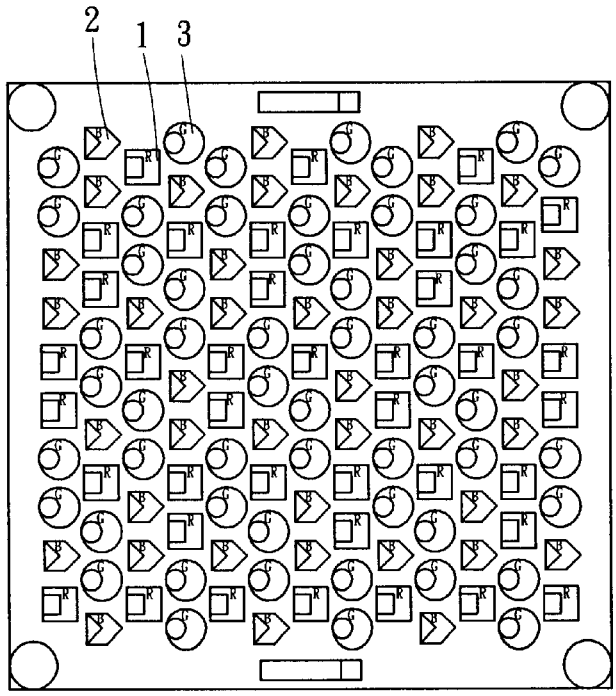
Prior Art Fig. 10
FIG. 10 is a schematic view of the arrangement of red, green, and blue LEDs on a conventional luminaire board.

FIG. 9 depicts the luminaire board designed in experiments of our company. Some of the LEDs are rotated by a certain degrees. FIG. 10 is a conventional design that all LEDs are aligned in the same direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A luminaire including an arrangement of a plurality of light emitting diodes (LED) and comprising:

a) a plurality of first light emitting diodes (LED), each emitting a first light beam of a first color;

b) at least one second light emitting diode (LED) emitting a second light beam of a second color, different from the first color; and, c) at least one third light emitting diode (LED) emitting a third light beam of a third color different from the first and second colors, the at least one third LED rotated resulting in the third light beam being circumferentially displaced from the second light beam at a predetermined angle, and both the second and third light beams are located within a cross-section of the first light beam.

2. The luminaire of claim 1 wherein the first light emitting diodes (LED) are red LEDs.

3. The luminaire of claim 2 wherein the at least one second light emitting diode (LED) comprises a blue LED.

4. The luminaire of claim 3 wherein the at least one third light emitting diode (LED) comprises a green LED.

5. The luminaire of claim 1 comprising a plurality of second light emitting diodes (LED).

6. The luminaire of claim 5 comprising a plurality of third light emitting diodes (LED).

* * * * *